US005313252A

United States Patent [19]

Castelli et al.

[11] Patent Number: 5,313,252

[45] Date of Patent: May 17, 1994

[54] APPARATUS AND METHOD FOR MEASURING AND CORRECTING IMAGE TRANSFER SMEAR

[75] Inventors: Vittorio Castelli, Yorktown Heights, N.Y.; Steven A. Buhler, Redondo Beach; Harold M. Anderson, Rancho Palos Verdes, both of Calif.

[73] Assignee: Xerox Corporation, Stamford, Conn.

[21] Appl. No.: 128,176

[22] Filed: Sep. 29, 1993

[51] Int. Cl.[5] ..... G03G 21/00

[52] U.S. Cl. ..... 355/203; 355/271; 355/275; 355/326

[58] Field of Search ..... 355/203, 208, 271, 273-276, 355/326-328; 346/157

[56] References Cited

U.S. PATENT DOCUMENTS

| | | | |
|---|---|---|---|
| 4,017,065 | 4/1977 | Poehlein | 271/80 |
| 4,017,067 | 4/1977 | Soures et al. | 271/80 |
| 4,847,660 | 7/1989 | Wheatley, Jr. et al. | 355/326 R X |
| 4,951,095 | 8/1990 | Warden | 355/271 |
| 5,160,946 | 11/1992 | Hwang | 346/157 |
| 5,166,735 | 11/1992 | Malachowski | 355/282 |
| 5,235,392 | 8/1993 | Hediger | 355/271 |
| 5,270,769 | 12/1993 | Satoh et al. | 355/326 R X |

*Primary Examiner*—A. T. Grimley
*Assistant Examiner*—William J. Royer
*Attorney, Agent, or Firm*—Kevin R. Kepner

[57] ABSTRACT

An apparatus and method for detecting and reducing image transfer smear is provided. A pattern consisting of a sequence of toner characters or marks separated by spaces is written and developed on a photoreceptive member and then transferred to an intermediate medium. As the pattern is transferred to the intermediate medium, the velocity of the photoreceptor is varied. A photodetector is used to detect the transferred pattern on the intermediate medium and generate a signal indicative thereof. As the detector senses the absence of toner, the signal generated is greater when the space between the toner characters is largest. By monitoring when the signal is greatest and determining the corresponding velocity of the photoreceptor at that time, the best velocity match between the photoreceptor and intermediate transfer medium can be determined and set.

12 Claims, 4 Drawing Sheets

APPARATUS AND METHOD FOR MEASURING AND CORRECTING IMAGE TRANSFER SMEAR

This invention relates generally to schemes to correct image transfer smear in electrophotographic printing machines, and more particularly concerns a device and methods for detecting and correcting image transfer smear in multiple print engine devices particularly those utilizing an intermediate transfer system.

In a typical electrophotographic printing process, a photoconductive member is charged to a substantially uniform potential so as to sensitize the surface thereof. The charged portion of the photoconductive member is exposed to a light image to selectively dissipate the charges thereon in the irradiated areas. This records an electrostatic latent image on the photoconductive member corresponding to the informational areas contained within the original document. After the electrostatic latent Image is recorded on the photoconductive member, the latent image is developed by bringing a developer material into contact therewith. Generally, the developer material comprises toner particles adhering electrostatically to carrier granules. The toner particles are attracted from the carrier granules to the latent image forming a toner powder image on the photoconductive member. The toner powder image is then transferred from the photoconductive member to a copy sheet by "tack" transfer: i.e., the copy sheet is attached to the photoreceptor with a sufficiently high force to overcome external forces that might otherwise tend to cause slip. The toner particles are heated to permanently affix the powder image to the copy sheet.

The foregoing generally describes a typical black and white electrophotographic printing machine. With the advent of multicolor electrophotography, it is desirable to use the so-called tandem architecture which comprises a plurality of image forming stations. This tandem architecture offers potential for high throughput and image quality. One choice of photoreceptors in this tandem engine architecture is a drum based photoreceptor architecture used in combination with an intermediate transfer medium. Belt type photoreceptors can also be used in combination with either an intermediate transfer belt or an intermediate transfer drum.

In any of the above mentioned configurations, when images are transferred from the photoreceptor to the intermediate medium by slip transfer, any velocity mismatch will result in image smear and a consequential degradation in image quality. It is desirable to be able to determine what if any velocity mismatch exists between each photoreceptor and the intermediate transfer medium and to minimize the difference so as to minimize smearing of the image.

The following disclosures may be relevant to various aspects of the present invention:

U.S. Pat. No. 5,166,735, Inventor: Malachowski, Issue Date: Nov. 24, 1992.

U.S. Pat. No. 5,160,946, Inventor: Hwang, Issue Date: Nov. 3, 1992.

U.S. Pat. No. 4,951,095, Inventor: Warden, Issue Date: Aug. 21, 1990.

U.S. Pat. No. 4,017,067, Inventor: Soures, et al., Issuer Date: Apr. 12, 1977.

U.S. Pat. No. 4,017,065, Inventor: Poehlein, Issue Date: Apr. 12, 1977.

The relevant portions of the foregoing disclosures may be briefly summarized as follows:

U.S. Pat. No. 5,166,735 to Malachowski discloses a sheet transport system incorporating a control for matching drive speeds imparted to a sheet extending between adjacent workstations. A copy sheet is engaged by a receiving surface disposed between the workstations and is adhered to the receiving surface by vacuum. The copy sheet follows a path offset from a linear path extending between the workstations. Fuser rolls are driven at a slightly higher speed to tension the copy sheet and lift it from the transport surface, the lifting is then detected by a sensor for sensing the vacuum In a plenum communicated with the receiving surface and the drive speed of the fuser rolls is controlled in accordance with the signal from the sensor.

U.S. Pat. No. 5,160,946 to Hwang discloses a registration system for an electrophotographic printing machine which forms registration indicia at a first transfer station and utilizes the formed indicia to register the image at subsequent transfer stations.

U.S. Pat. No. 4,951,095 to Warden discloses a xerographic copy machine having a circulating endless belt photoreceptor. A sheet is fed to the transfer region by a pair of coating rolls driven by a variable speed step motor. The rolls feed the leading portion of the copy sheet at approximately the same speed as the photoreceptor and when the copy sheet contacts the photoreceptor, the feed rolls are driven at a faster speed for a short interval to generate a buckle in a copy sheet just before the transfer region. The speed of the feed rolls is then returned to the initial value so that the buckle size remains constant while the remainder of the sheet is fed. The buckle provides sufficient surplus in the copy sheet to prevent it being pulled taught in the transfer region and thereby smearing the unfused toner image.

U.S. Pat. No. 4,017,067 to Soures, et al. describes an electrostatographic copier wherein the fuser rolls are positioned closer than the dimensions of the copy sheet from the image transfer area. Speed mismatch compensation between the fuser roll nip and the transfer region is provided by intentionally driving the fuser roll nip at a different preset velocity to form a buckle in the intermediate portion of the copy sheet, the buckle being controlled by selective cyclic reductions in the vacuum applied to a vacuum changer sheet guide surface between the fuser nip and the transfers area.

U.S. Pat. No. 4,017,065 to Poehlein describes an electrostatographic copier, wherein the fuser rolls are positioned closer than the dimensions of the copy sheet from the image transfer area. Speed mismatch compensation between the fuser roll nip and the image transfer area is provided by intentionally driving the fuser roll at a different velocity to form a buckle in the intermediate portion of the copy sheet, the buckle controlled by selective cyclic reductions in the vacuum applied to a configured manifold guide surface. The guide surface may be divided into segments through one of which the vacuum is continuously maintained.

In accordance with one aspect of the present invention, there is provided an apparatus for detecting and correcting image transfer smear. The apparatus comprises an image carrying member moving at a first velocity along a predetermined path and means, moving at a second velocity, for applying a developed toner image in a selected pattern to said image carrying member. Means for detecting the pattern of the toner image on said image carrying member and generating a signal indicative thereof and a controller coupled to said applying means, said controller being responsive to the signal generated by said detecting means, to adjust the second velocity of said applying means to substantially match the first velocity of said image carrying member so as to minimize the relative velocity mismatch therebetween are also provided.

Pursuant to another aspect of the present invention, there is provided a method for detecting and correcting image transfer smear. The method comprises the steps of moving an image carrying member at a first velocity along a predetermined path and applying a developed toner image, moving at a second velocity, in a selected pattern to said image carrying member. The method also includes the steps of detecting the pattern of the toner image on said image carrying member and generating a signal indicative thereof and adjusting the second velocity, responsive to the signal generated, to substantially match the first velocity of said image carrying member so as to minimize the relative velocity mismatch therebetween.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
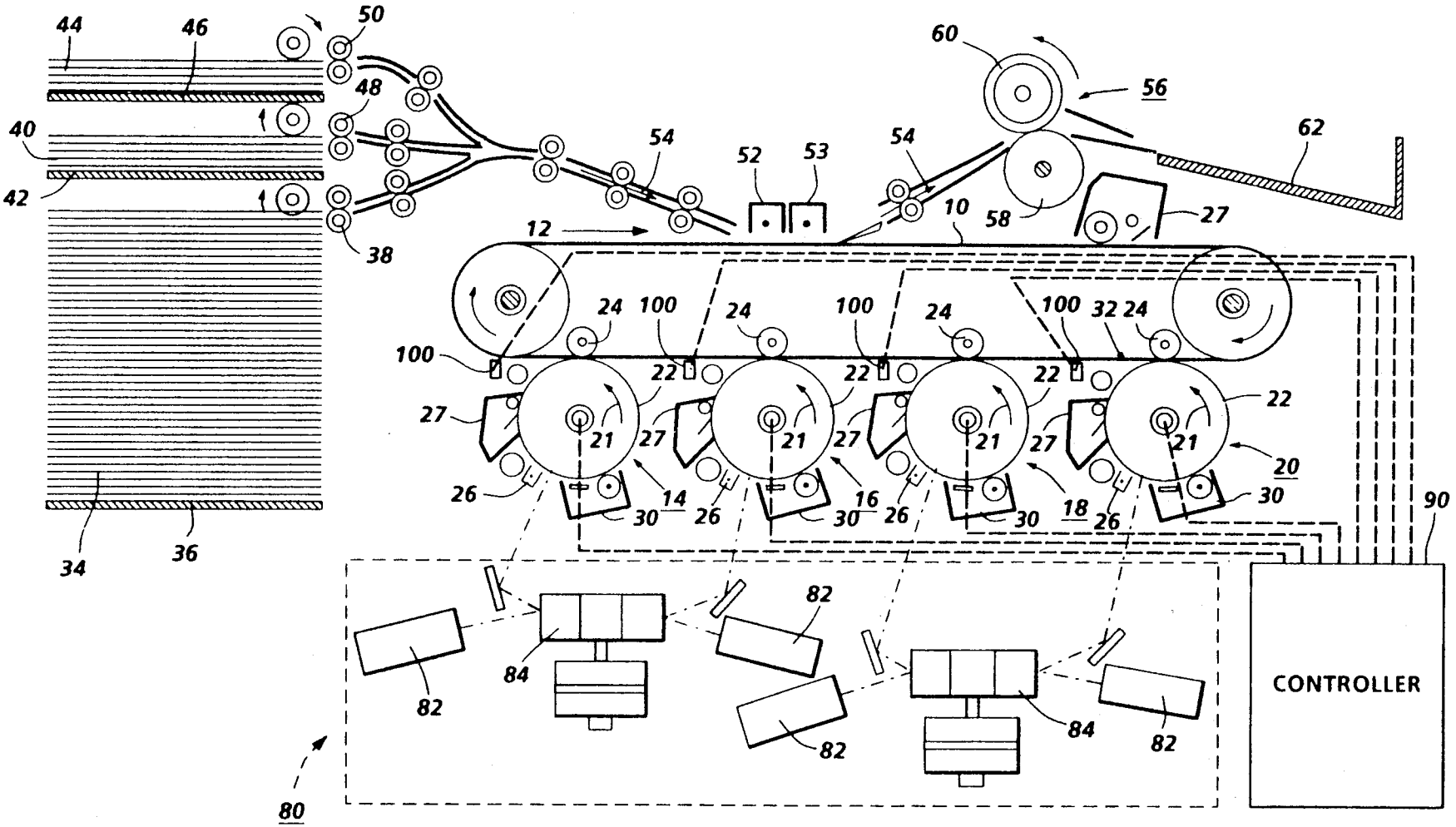
FIG. 5 is a schematic elevational view depicting an illustrative multicolor electrophotographic printing machine incorporating the apparatus of the present invention.

For a general understanding of the features of the present invention references are made to the drawings. In the drawings, like reference numerals have been used throughout to designate identical elements. Referring now to FIG. 5, an intermediate belt designated generally by the reference numeral 10 is mounted rotatably on the machine frame. Belt 10 rotates in the direction of arrow 12. Four imaging reproducing stations indicated generally by the reference numerals 14, 16, 18 and 20 are positioned about the periphery of the belt 10. Each image reproducing station is substantially identical to one another. The only distinctions between the image reproducing stations is their position and the color of the developer material employed therein. For example, image reproducing station 14 uses a black developer material, while stations 16, 18 and 20 use yellow, magenta and cyan colored developer material. Inasmuch as stations 14, 16, 18 and 20 are similar, only station 20 will be described in detail.

At station 20, a drum 22 having a photoconductive surface deposited on a conductive substrate rotates in direction of arrow 21. Preferably, the photoconductive surface is made from a selenium alloy with the conductive substrate being made from an electronically grounded aluminum alloy. Other suitable photoconductive surfaces and conductive substrates may also be employed. Drum 22 rotates in the direction of arrow 21 to advance successive portions of the photoconductive surface through the various processing stations disposed about the path of movement thereof.

Initially, a portion of the photoconductive surface of drum 22 passes beneath a corona generating device 26. Corona generating device 26 charges the photoconductive surface of the drum 22 to a relatively high, substantially uniform potential.

Next, the charged portion of the photoconductive surface is advanced through the imaging station. At the imaging station, an imaging unit indicated generally by the reference numeral 80, records an electrostatic latent image on the photoconductive surface of the drum 22. Imaging unit 80 includes a raster output scanner. The raster output scanner lays out the electrostatic latent image in a series of horizontal scan lines with each line having a specified number of pixels per inch. Preferably, the raster output scanner employs a laser 82 which generates a modulated beam of light rays which are scanned across the drum 22 by rotating a polygon mirror 84. Alternatively, the raster output scanner may use light emitting diode array write bars. In this way, an electrostatic latent image is recorded on the photoconductive surface of the drum 22.

Next, a developer unit indicated generally by the reference numeral 30 develops the electrostatic latent image with a cyan colored developer material. Image reproducing stations 14, 16 and 18 use black, yellow and magenta colored developer materials respectively. The latent image attracts toner particles from the carrier granules of the developer material to form a toner powder image on the photoconductive surface of drum 22. After development of the latent image with cyan toner, drum 22 continues to move in direction of arrow 21 to advance the cyan toner image to a transfer zone 32 where the cyan toner image is transferred from drum 22 to intermediate belt 10 by an intermediate transfer device such as a biased transfer roll 24.

At transfer zone 32, the developed powder image is transferred from photoconductive drum 22 to intermediate belt 10. By utilizing the apparatus and method described herein, belt 10 and drum 22 have substantially the same tangential velocity in the transfer zone 32. Belt 10 is electrically biased to a potential of sufficient magnitude and polarity by biased transfer roll 24 to attract the developed powder image thereto from drum 22. Preferably, belt 10 is made from a conductive substrate with an appropriate dielectric coating such as a metallized polyester film.

After the cyan toner Image is transferred to the belt 10 at reproducing station 20, belt 10 advances the cyan toner image to the transfer zone of reproducing station 18 where a magenta toner Image is transferred to belt 10, in superimposed registration with the cyan toner image previously transferred to belt 10. After the magenta toner image is transferred to belt 10, belt 10 advances the transferred toner images to reproducing station 16 where the yellow toner image is transferred to belt 10 in superimposed registration with the previously transferred toner images. Finally, belt 10 advances the transferred toner images to reproducing station 14 where the black toner image is transferred thereto in superimposed registration with the previously transferred toner images. After all of the toner images have been transferred to belt 10 in superimposed registration with one another to form a multicolor toner image, the multicolor toner image is transferred to a sheet of support material, e.g., a copy paper at the transfer station.

At the transfer station, a copy sheet is moved into contact with the multicolor toner Image on belt 10. The copy sheet is advanced to transfer station from a stack of sheets 34 mounted on a tray 36 by a sheet feeder 38 or from either a stack of sheets 40 on tray 42 or a stack of sheets 44 on a tray 46 by either sheet feeder 48 or sheet feeder 50. The copy sheet is advanced into contact with the multicolor image on belt 10 beneath corona generating unit 52 at the transfer station. Corona generating unit 52 sprays ions on to the back side of the sheet to attract the multicolor image to the front side thereof from belt 10. After transfer, the copy sheet passes under a second corona generating unit 53 for detack and continues to move in the direction of arrow 54 to a fusing station. The fusing station includes a fuser assembly generally indicated by the reference numeral 56, which permanently affixes the transferred toner image to the copy sheet. Preferably, fuser assembly 56 includes a heated fuser roll 58 and a backup roller 60 with the toner image on the copy sheet contacting fuser roller 58. In this manner, the toner Image is permanently affixed to the copy sheet. After fusing, the copy sheets are then fed either to an output tray 62 or to a finishing station, which may include a stapler or binding mechanism.

Referring once again to reproducing station 20, invariably, after the toner image is transferred from drum 22 to belt 10, some residual particles remain adhering thereto. These residual particles are removed from the drum surface 22 at the cleaning station 27. Cleaning station includes a rotatably mounted fibrous or electrostatic brush in contact with the photoconductive surface of drum 22. The particles are cleaned from the drum 22 by rotation of the brush in contact therewith.

Belt 10 is cleaned in a like manner after transfer of the multicolor image to the copy sheet. Subsequent to cleaning, a discharge lamp (not shown) floods the photoconductive surface of drum 22 to dissipate any residual electrostatic charge remaining thereon prior to the charging thereof for the next successive imaging cycle.

It is believed that the foregoing description is sufficient for the purposes of the present application to illustrate the general operation of a tandem printing machine.

Slip transfer is a term which indicates that relative motion may exist between the image carrier and the image recipient in the contact area within which transfer occurs. This usually implies that the mating elements (a photoreceptor, intermediate transfer medium, or a sheet) are independently driven. In a tandem printing machine, this technique is employed to obviate the effects on registration of size mismatch between the various photoreceptors in terms of their barrel convexities, conicities and radii. One way in which to measure image distortions as well as relative registration in multi-color or monochromatic image output terminals (IOT), is to print special marks which are automatically interpreted. Machine architectures that utilize an intermediate transfer medium can employ a marks-on-belt detector, which consists of optics, photodetectors and the requisite circuitry to process the signals. The marks-on-belt detector can measure characteristics of marks placed on the photoreceptor or image receiving medium that reveal information regarding the motion of the photoreceptors relative to the intermediate medium.

The device and methods of the current invention relate to measuring what is known as the D/C error of velocity match in the process direction. The error is referred to as a D/C error in that its magnitude is constant with respect to time and does not vary in time such as an error caused by the cyclical defects due to eccentricities, poor mounting, etc. which may be found between a photoreceptor and an intermediate transfer medium. The error detected by the methods of this invention results from imprecise knowledge of roller and drum diameters combined with speed controls that usually employ imprecise rotating elements. The present invention discloses an apparatus, techniques and methods that employ special patterns that are imaged and developed on the photoreceptor, transferred to the intermediate medium and measured by a marks-on-belt detector. Processing of the marks-on-belt detector data enable determination and establishment of the photoreceptor velocity that results in minimum smearing.

As the errors detected and corrected by the invention herein are constant, the corrective scheme need only be utilized at machine start up and at other predetermined intervals to maintain the proper velocity match. The correction scheme will then detect and correct errors that may result from wear of drive mechanisms, etc. without the need for a constant monitoring and feedback system.

Figure 1:
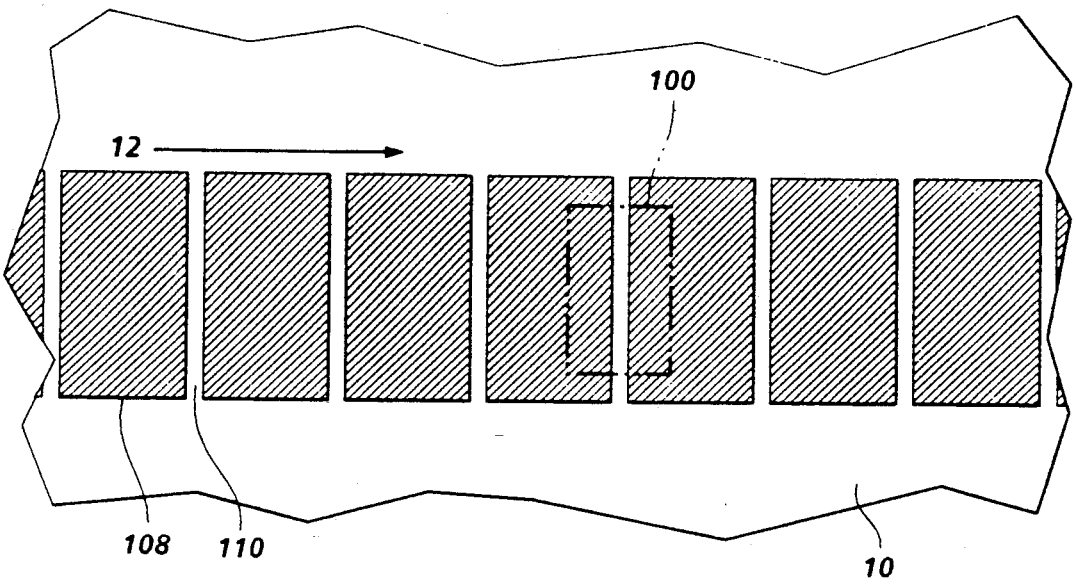
FIG. 1 illustrates a transfer pattern which should be written and developed on each photoreceptor and transferred to the intermediate belt in practicing the correction scheme of the present invention.
Figure 2:
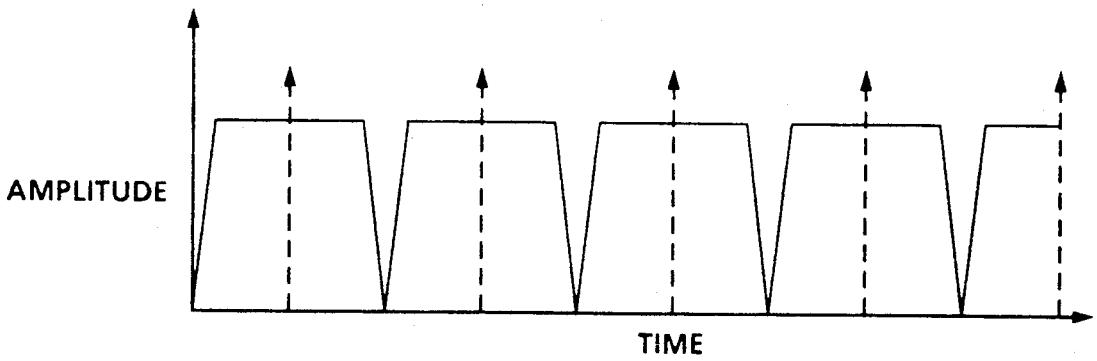
FIG. 2 illustrates the graph of the detector signal for the pattern shown in FIG. 1 transferred with a constant DC velocity error.

Turning first to FIG. 1, there is shown a transfer pattern which should be written and developed on each photoreceptor and transferred to the intermediate belt. The pattern consists of a series of spaced rectangular elements. The process direction is indicated by arrow 12. The gaps 110 between the rectangular elements 108 of the pattern should be equal to one or more pixel widths. An enlarged representation of a detector element 100 is shown in a position to detect the pattern written on and transferred to the belt. As an example, a 0.010 inch element of a photodetector may be used to detect the signal from the one pixel gaps as the pattern passes by. FIG. 2 illustrates the graph of the detector signal for a constant D/C error for the pattern shown in FIG. 1. A strobe signal is timed to nominally appear in the pattern detection when the gap in the pattern is passing through the center of the photodetector cell. If a one pixel gap (which is equal to 0.00167 inches at 600 spots per inch) is developed and transferred without fill-in, then a 1.39% velocity error would produce a smear of one pixel (0.00167 inches) if the effective transfer zone length is 0.120 inches. If the fill-in is significant, then the gap should be greater than one pixel so that a spaced area can be detected. Above, the term "effective transfer zone" is used to indicate the region where some of the toner is still on the photoreceptor and some has already been transferred to the intermediate medium.

Figure 4A:
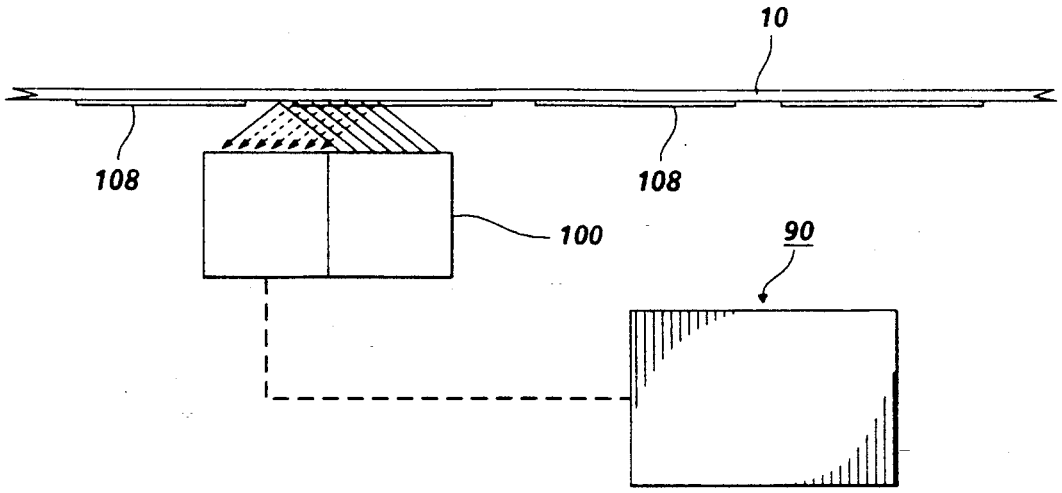
FIGS. 4A and 4B illustrate photodetective sensors of the type utilized in practicing the correction scheme of the present invention.
Figure 4B:
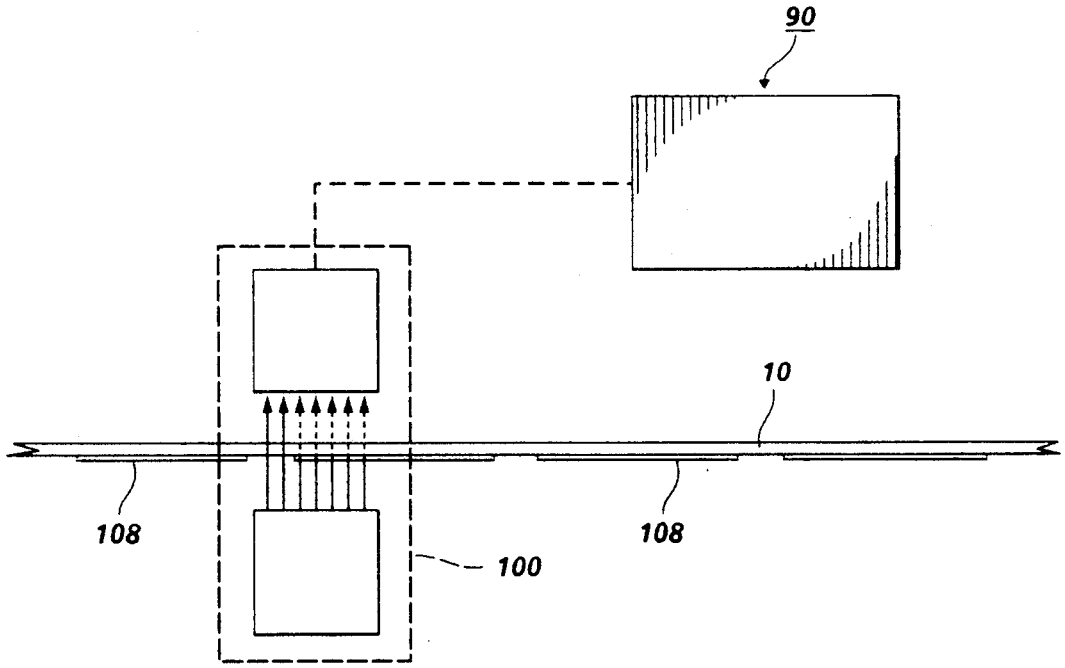

Two automated procedures will be described to determine the best velocity match between the photoreceptor and the intermediate transfer medium. The first method is to vary the photoreceptor velocity in small steps and to determine for each velocity the maximum detected amplitude in the wave form corresponding to the output signal generated by the detector. Since the image 108 has been developed, the patterns thereof are optically readable by illuminating them with a light emitter and sensing the patterns of reflected light. In order to detect the pattern, there must be adequate contrast between the intermediate medium and the toner. If the intermediate medium is specularly reflective and the toners either diffusely reflect the light or absorb it, then the pattern might be detected by specular reflection as shown in FIG. 4A. On the other hand, if the intermediate medium is absorptive and the toners diffusely reflect light, then the diffusely reflected light could be collected by a lens and imaged on the detector. In one embodiment, each of the sensors 100 would be a known photoemitter/photosensor pair. Preferably, the emitter/sensor pair is In close proximity because the reflected light pattern is more precisely detected by such a device. Alternatively, as shown in FIG. 4B, if the intermediate belt 10 is transparent and the image is not, the emitter/sensor pair can be separated by the intermediate belt 10. The toned image 108 would then pass between the pair and provide a pattern of transmitted light.

The detector utilized is of the type described above which detects the degree of luminosity, which value is greater in the areas void of the toner pattern. Accordingly, the greater the amplitude of the signal, the greater the space between the toner portions of the pattern which indicates less smear during transfer. Thus, the maximum amplitude signal would be equivalent to the velocity that produces the least amount of smear and the velocity which resulted in the maximum signal amplitude would be the best velocity match between the photoreceptor and the intermediate transfer belt.

The signal from the photodetector is sent to the controller 90, which can be a known microprocessor, and is monitored while the velocity of the photoreceptor drive motor is varied by the controller and likewise monitored by the controller 90. When the pattern is the least smeared, the signal received is of the greatest amplitude, and the corresponding velocity of the photoreceptor is determined and set by the controller thereby resulting in the best velocity match between the photoreceptor and the intermediate transfer belt.

A second method is for for the controller to slew the velocity of the photoreceptor from a value of 0.985 of a nominal velocity (which nominal velocity is the predicted velocity of the intermediate transfer belt based on the drive speed of the transfer belt) to a value of 1.015 of the nominal velocity over a ten inch length of the photoreceptor. A sample and hold peak detector portion of the controller 90 stores the highest value of the signal received from the photodetector and also its associated byte location. The stored byte location for the highest peak value is then associated with the best velocity match and the controller 90 drives the photoreceptor at that velocity.

Figure 3:
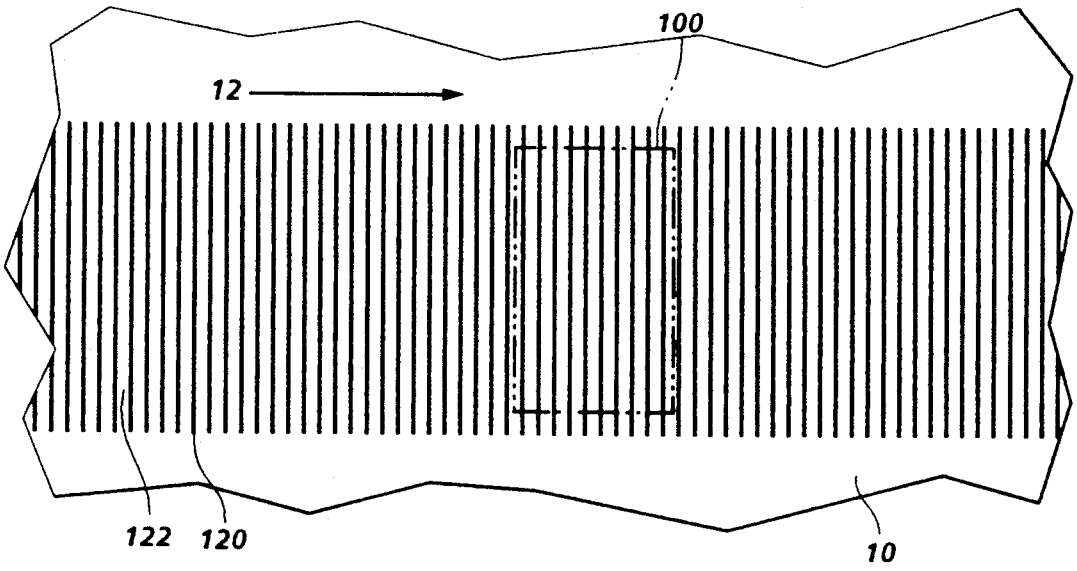
FIG. 3 illustrates the repetitive pattern utilized in the manual, visual method of performing the velocity correction and velocity matching of the present invention.

A second embodiment of the smear detection and correction system utilizes a pattern such as that which is illustrated in FIG. 3. A pattern consisting of a series of marks 120 one pixel wide followed by a space 122 of one pixel, substantially perpendicular to the process direction is written on the photoreceptor and transferred to the intermediate transfer belt. In this embodiment, a 0.020 inch photodetector 100 is utilized to generate a signal in response to the detection of the pattern which has been transferred to the intermediate transfer belt 10. As with the first method described above, the photoreceptor velocity is again slewed by the controller 90 from 0.985 of the nominal velocity to 1.015 of the nominal velocity over a ten inch length. The analog output of the detector is then sampled by the controller 90 every 0.020 inches of travel. A sample and hold peak detector stores the highest value recorded on the output of the detector and its associated byte location. The byte location for the finally stored peak value is then associated with the velocity match which results in the least amount of smearing and the controller 90 sets the velocity accordingly.

It is also possible to perform a nonautomated, visual procedure to determine the best velocity match between the photoreceptor and the intermediate transfer medium. Once again, the photoreceptor velocity is slewed from 0.985 of a nominal velocity to 1.015 of a nominal velocity over a ten inch length as the imager produces a repetitive pattern of an equal number of lines on and lines off such as that illustrated in FIG. 3. The pattern is then transferred and printed to a sheet of paper and visually examined. There should be two zones on the printed page where there is no space between the lines as a result of smearing and a zone where the image is brightest to the eye. A line along the length of the paper at the centroid of the brightest zone represents the photoreceptor velocity that matches the velocity of the intermediate medium. If the line along the sheet can be located to within 1/1000 of an inch, then the velocity match can be determined to an accuracy of 0.03% which is within the criteria for maximum permissible relative velocity between the photoreceptor and the intermediate transfer belt which is 0.333% so as to prevent perceptible smearing. The number of lines on is best chosen to be as the smallest developable one by the technology employed in the machine.

In recapitulation, an apparatus and method for reducing image transfer smear is provided. A pattern consisting of a sequence of characters separated by spaces is written and developed with toner on a photoreceptive member and then transferred to an intermediate medium. As the pattern is transferred to the intermediate medium, the velocity of the photoreceptor is varied. A photodetector is used to detect the transferred pattern on the intermediate medium and generate a signal indicative thereof. As the detector senses the absence of toner, the signal generated is greater when the space between the toner characters is largest. By monitoring when the signal is greatest and determining the corresponding velocity of the photoreceptor at that time, the best velocity match between the photoreceptor and intermediate transfer medium can be determined and set.

It is, therefore, apparent that there has been provided in accordance with the present invention, an apparatus and method for minimizing image transfer smear that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for detecting and correcting image transfer smear comprising:

an image carrying member moving at a first velocity along a predetermined path;

means, moving at a second velocity, for applying a developed toner image in a selected pattern to said image carrying member;

means for detecting the pattern of the toner image on said image carrying member and generating a signal indicative thereof; and a controller coupled to said applying means, said controller being responsive to the signal generated by said detecting means, to adjust the second velocity of said applying means to substantially match the first velocity of said image carrying member so as to minimize the relative velocity mismatch therebetween.

2. The apparatus according to claim 1, wherein said applying means comprises a plurality of electrophotographic print engines.

3. The apparatus according to claim 2, wherein each of said plurality of print engines comprises:

a photoreceptive member moving at the second velocity along a predetermined path;

means for recording a latent image on said photoreceptive member;

means for developing the latent image with toner; and means for transferring the toner image from said photoreceptive member to said image carrying member.

4. The apparatus according to claim 3, wherein said detecting means comprises a photo-optic detector which senses the luminosity of a surface and generates a signal indicative thereof, said photo-optic detector including a light emitter adapted to illuminate the toner image on said image carrying member and a sensor adapted to receive the illuminated pattern from said image in contrast with the image carrying member and generate a signal indicative thereof.

5. The apparatus according to claim 4, wherein said controller comprises means for driving said photoreceptive member at varying velocities ranging from a velocity incrementally less than a nominal velocity to a velocity incrementally greater than the nominal velocity wherein the nominal velocity is a predicted first velocity of said image carrying member.

6. The apparatus according to claim 5, wherein said controller comprises a microprocessor adapted to receive the signal generated by said photo-optic detector and determine the second velocity of said photoreceptive member that most closely matches the first velocity of said image carrying member, and sets said means for driving said photoreceptive member at the second velocity.

7. A method for detecting and correcting image transfer smear comprising the steps of:

moving an image carrying member at a first velocity along a predetermined path;

applying a developed toner image, moving at a second velocity, in a selected pattern to said image carrying member;

detecting the pattern of the toner image on said image carrying member and generating a signal indicative thereof; and adjusting the second velocity, responsive to the signal generated, to substantially match the first velocity of said image carrying member so as to minimize the relative velocity mismatch therebetween.

8. The method according to claim 7, wherein said applying step comprises:

imaging a series of spaced apart characters on a photoreceptive member;

developing the characters with toner on the photoreceptive member; and transferring the characters from the photoreceptive member to the image carrying member.

9. The method according to claim 8, wherein said detecting and generating step comprises sensing the transferred character with a photooptic device which includes a light emitter to illuminate the toner characters or marks and a light receptor which senses the illuminated characters or marks and emits a signal, the amplitude of which varies as a function of the luminosity of the surface being sensed.

10. The method according to claim 9, further comprising the step of varying the velocity of the photoreceptive member from a velocity incrementally less than a nominal velocity to a velocity incrementally greater than the nominal velocity wherein the nominal velocity is the predicted first velocity of said image carrying member.

11. The method according to claim 10, comprising the step of comparing the signal generated for each speed of the photoreceptive member and setting the speed of the photoreceptive member at that speed which results in the greatest amplitude of signal generated by the photooptic device.

12. The method according to claim 11, comprising the step of repeating a plurality of applying steps to create a multi-color toner image, on the image carrying member.

* * * * *